US006799445B1

(12) United States Patent
Tsai

(10) Patent No.: US 6,799,445 B1
(45) Date of Patent: Oct. 5, 2004

(54) DUAL-USE LOCK WHOSE UNLOCKING NUMERAL COMBINATION CAN BE TRACED AFTER HAVING BEEN FORGOTTEN

(75) Inventor: Cheng-Tao Tsai, Tainan (TW)

(73) Assignee: Jaeyou Co., Ltd., Tainan (TW)

( * ) Notice: Subject to any disclaimer, the term of this patent is extended or adjusted under 35 U.S.C. 154(b) by 0 days.

(21) Appl. No.: 10/720,207

(22) Filed: Nov. 25, 2003

(51) Int. Cl.[7] ..... E05B 37/02

(52) U.S. Cl. ..... 70/30; 70/49; 70/284; 70/285; 70/312; 70/446

(58) Field of Search ..... 70/26, 30, 49, 70/287, 285, 312, 446, 315–318, 331, 465, DIG. 63, DIG. 71

(56) References Cited

U.S. PATENT DOCUMENTS

| | | | | | |
|---|---|---|---|---|---|
| 148,451 | A | * | 3/1874 | Hall | 70/330 |
| 972,171 | A | * | 10/1910 | Dupont | 70/21 |
| 1,384,390 | A | * | 7/1921 | Judycki | 70/21 |
| 1,688,208 | A | * | 10/1928 | Amedeo | 70/21 |
| 1,755,521 | A | * | 4/1930 | Smith | 70/21 |
| 5,636,539 | A | * | 6/1997 | Tsai | 70/315 |
| 6,386,005 | B1 | * | 5/2002 | Kuo | 70/28 |
| 6,422,051 | B1 | * | 7/2002 | Kuo | 70/312 |
| 6,539,761 | B2 | * | 4/2003 | Yang | 70/284 |
| 6,708,534 | B1 | * | 3/2004 | Ruan | 70/38 A |

* cited by examiner

*Primary Examiner*—Lloyd A. Gall
(74) *Attorney, Agent, or Firm*—Rosenberg, Klein & Lee

(57) ABSTRACT

A dual-use lock includes a toothed male member, a female member, a spindle for connecting the male member to the female member, several dials around the spindle, and an auxiliary lock; each dial has numerals thereon, and has a dish turnable together with it; the male member can separate from the spindle when the dials are turned to unlocking orientation, but it can't after the dials are turned away from the unlocking orientation; the auxiliary lock is fitted to the female member for releaseably securing the spindle to the female member, and can be operated with a key; thus, an object locked with the dual-use lock can be released even if unlocking combination of the dials has been forgotten; the tooth dishes are made such that the combination can be traced with the help of a probe after separation of the spindle from the female member.

2 Claims, 6 Drawing Sheets

DUAL-USE LOCK WHOSE UNLOCKING NUMERAL COMBINATION CAN BE TRACED AFTER HAVING BEEN FORGOTTEN

BACKGROUND OF THE INVENTION

1. Field of the Invention

The present invention relates to a dual-use lock, which can be changed in the unlocking numeral combination, and whose unlocking numeral combination can be traced after having been forgotten.

2. Brief Description of the Prior Art

Combination locks are usually used on suitcases, cable locks etc. There are many kinds of combination locks that are suitable for use with cables, among which combination locks there are those capable of being changed in the combination.

Referring to FIG. 6, a conventional changeable combination lock includes:

a male member 90, which has an insertion rod 901 having several aligned engaging teeth 902 equidistantly spaced along it;

a spindle 95, which has a rod portion, and a head portion wider than the rod portion; the rod portion has a trench 951, and several protrusions 952 equidistantly spaced along it; the head portion has a holding space 953, and a locating gap 9531;

a pad 954 having a through hole 9541, and posts 9542; the pad 954 being movably positioned in the holding space 953 of the spindle 95 with the through hole 9541 being aligned with the trench 951, and with the posts 9542 being inserted through the head portion of the spindle 95;

a pressing block 955 having a through hole 9551, and engaging projections 9552; the pressing block 955 being movably held in the holding space 953 of the spindle 95 with the through hole 9551 being aligned with the trench 951 such that the pressing block 955 will be pressed against the pad 954 to make the posts 9542 further project out from the head portion of the spindle 95 when it is pressed;

several dials 91 arranged one next to another; each of the dials 91 has numerals spaced out on an outer side, an inserting hole 911 on the middle, several flat portions (not numbered) of equal size on the annular inward side thereof, equidistantly spaced teeth 912 next to respective ones of the flat portions, and holding spaces 913 between the teeth 912;

several tooth dishes 92, each of which has an inserting hole 921, a gap 923 on an inner side, and a convex tooth 922 on an outward side thereof;

several locating elements 93, each of which has a through hole 931, and has an elastic element 932 fitted thereto; the tooth dishes 92 and the locating elements 93 being arranged in respective dials 91 while the rod portion of the spindle 95 is inserted in the holes 911, 921, and 931;

a spring 94 biasing the tooth dishes 92 and the locating elements 93 towards the head portion of the spindle 95 so that the convex teeth 922 of the tooth dishes 92 are held in the holding spaces 913 of the dials 91;

the elastic elements 932 come into contact with the flat portions of corresponding dials 91; in case the pressing block 955 is not pressed, the convex teeth 922 of the tooth dishes 92 will be held in the holding spaces 913 of the dials 91 for the tooth dishes 92 to be turnable together with the dials 91; in case the pressing block 955 is pressed to push the pad 954, the convex teeth 922 will be separated from the holding spaces 913, and in turns, the tooth dishes 92 can't turn together with the dials 91;

a protecting ring 956 connected with the head portion of the spindle 95 to surround the pad 954, and the pressing block 955; the protecting ring 956 having a protrusion 9561 fitted in the locating gap 9531 of the spindle 95; and a female member 97 securely connected with a tail end of the rod portion of the spindle 95; a connecting pin 96 is inserted in a fitting hole 971 of the female member 97 as well as the rod portion of the spindle 95.

Therefore, the male member 90 will be secured to the spindle 95 with the teeth 902 thereof being stopped by the tooth dishes 92 after it is inserted in the trench 951, and after the dials 91 is turned away from the unlocking orientation; the gaps 923 will be aligned with the teeth 902, and the male member 90 can be separated from the spindle 95 after all the dials 91 are turned to the unlocking orientation. And, unlocking numeral combination of the lock can be changed after the pressing block 955 is pressed, the dials 91 turned to change the numerals that correspond to the gaps 923 of the tooth dishes 92, and the block 955 released.

However, the above changeable combination lock has a disadvantage, which is common to most changeable combination locks, that it can't be unlocked in case the user has forgotten the unlocking numeral combination. Consequently, the user will have to break the lock or the chain used with the lock otherwise the object locked with the lock can't be released.

SUMMARY OF THE INVENTION

It is a main object of the present invention to provide a dual-use lock to overcome the above disadvantage.

The dual-use lock includes a toothed male member, a female member, a spindle for connecting the male member to the female member, several dial assemblies arranged around the spindle, and an auxiliary lock. Each dial assembly includes both a dial with numerals thereon, and a tooth dish releaseably engaging the dial to turn together with the dial. The male member is allowed to separate from the spindle when the dials are turned to an unlocking orientation. The male member can't separate from the spindle when the dials are turned away from the unlocking orientation. The auxiliary lock is fitted to the female member for releaseably securing the spindle to the female member, and is operated with a key. Thus, an object locked with the present dual-use lock still can be released even if the user has forgotten the unlocking numeral combination of the dials. The tooth dishes are made such that the unlocking numeral combination of the dials can be easily traced with the help of a probe after separation of the spindle from the female member.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
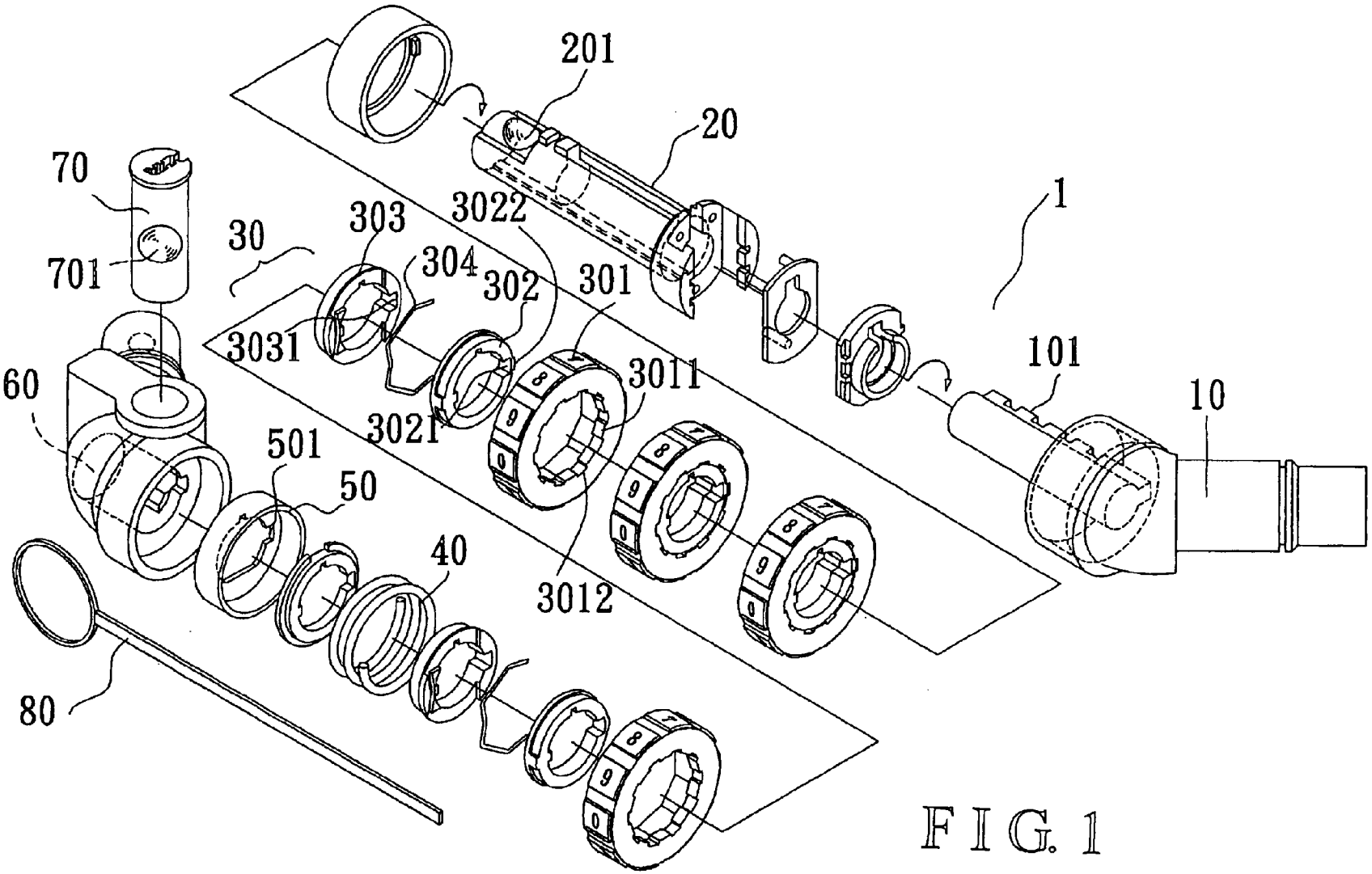
FIG. 1 is an exploded perspective view of the dual-use lock according to the present invention.
Figure 3:
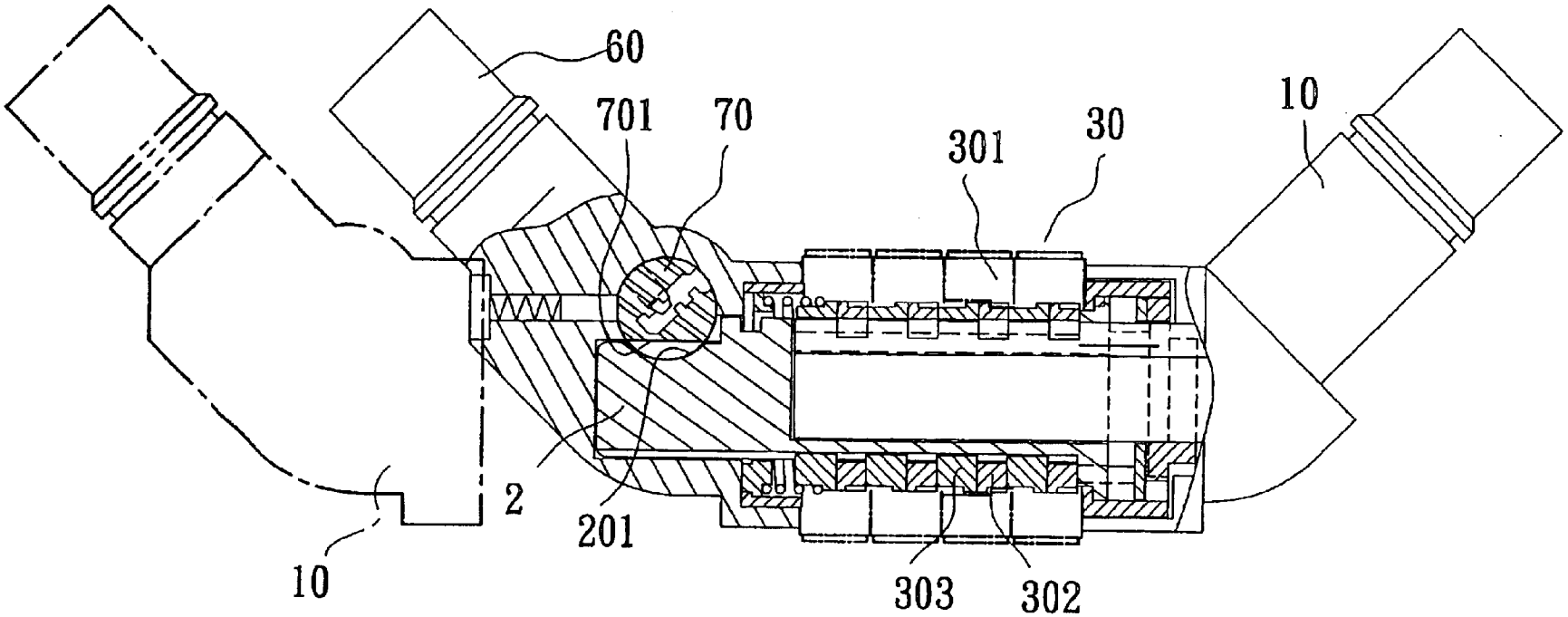
FIG. 3 is a cross-sectional view of the dual-use lock of the present invention under a first step of the combination tracing operation.

Referring to FIG. 1, a preferred embodiment of a dual-use lock in the present invention includes:

a male member 10, which is connected with one end of a cable, and has an insertion rod having several aligned teeth 101 equidistantly spaced along it;

a spindle 20 for allowing the male member 10 to be releaseably inserted therein; the spindle 20 has a rod portion, which has a securing recess 201 on a tail end thereof;

several dial assemblies 30 arranged one next to another around the rod portion of the spindle 20; each dial assembly 30 includes a dial 301, a tooth dish 302, and a locating element 303; each dial 301 has numerals spaced out on an outer side, equidistantly spaced teeth 3011, and holding spaces 3012 between the teeth 3011; each tooth dish 302 has a gap 3021 on an inner side, and at least one tooth 3022 on an outward side thereof; the locating elements 303 can't turn relative to the spindle 20; each locating element 303 has a gap 3031 on an inner side, and has an elastic element 304 fitted thereto; the tooth dishes 302 and the locating elements 303 are arranged in respective dials 301 with the elastic elements 304 coming into contact with annular inward sides of the dials 301, and with the gaps 3031 being aligned with each other; the teeth 3022 of the tooth dishes 302 are normally held in the holding spaces 3012 of the dials 301 so that the tooth dishes 302 will turn together with respective dials 301; after the tooth dishes 302 are pushed so as to move the teeth 3022 out of the holding spaces 3012, the tooth dishes 302 won't turn together with respective dials 301, and in turns, the unlocking numeral combination can be changed;

a spring 40 biasing the tooth dishes 302 and the locating elements 303 towards the head portion of the spindle 20 so that the teeth 3022 of the tooth dishes 302 are held in the holding spaces 3012 of the dials 301;

a protecting cap 50 disposed around, and securely connected with the rod portion of the spindle 20 in front of the securing recess 201 and behind a rearmost one of the locating elements 303; the protecting cap 50 has a gap 501 aligned with the gaps 3031 of the locating elements 303;

an auxiliary lock member 70 operable with a key; the auxiliary lock member 70 has a recess 701, and an engaging portion (not numbered) next to the recess 701; and a female member 60, which is connected with other end of the cable, and positioned around the tail end of the rod portion of the spindle 20, and securely connected with the tail end of the spindle 20 by means of the auxiliary lock member 70, which is fitted to the female member 60; the spindle 20 will be prevented from separating from the female member 60 when the engaging portion of the auxiliary lock member 70 is fitted in the securing recess 201 of the spindle 20; the spindle 20 will be allowed to separate from the female member 60 after the auxiliary lock member 70 is operated with the key so as to make the recess 701 oppose the securing recess 201 of the spindle 20, as shown in FIG. 3.

Figure 2:
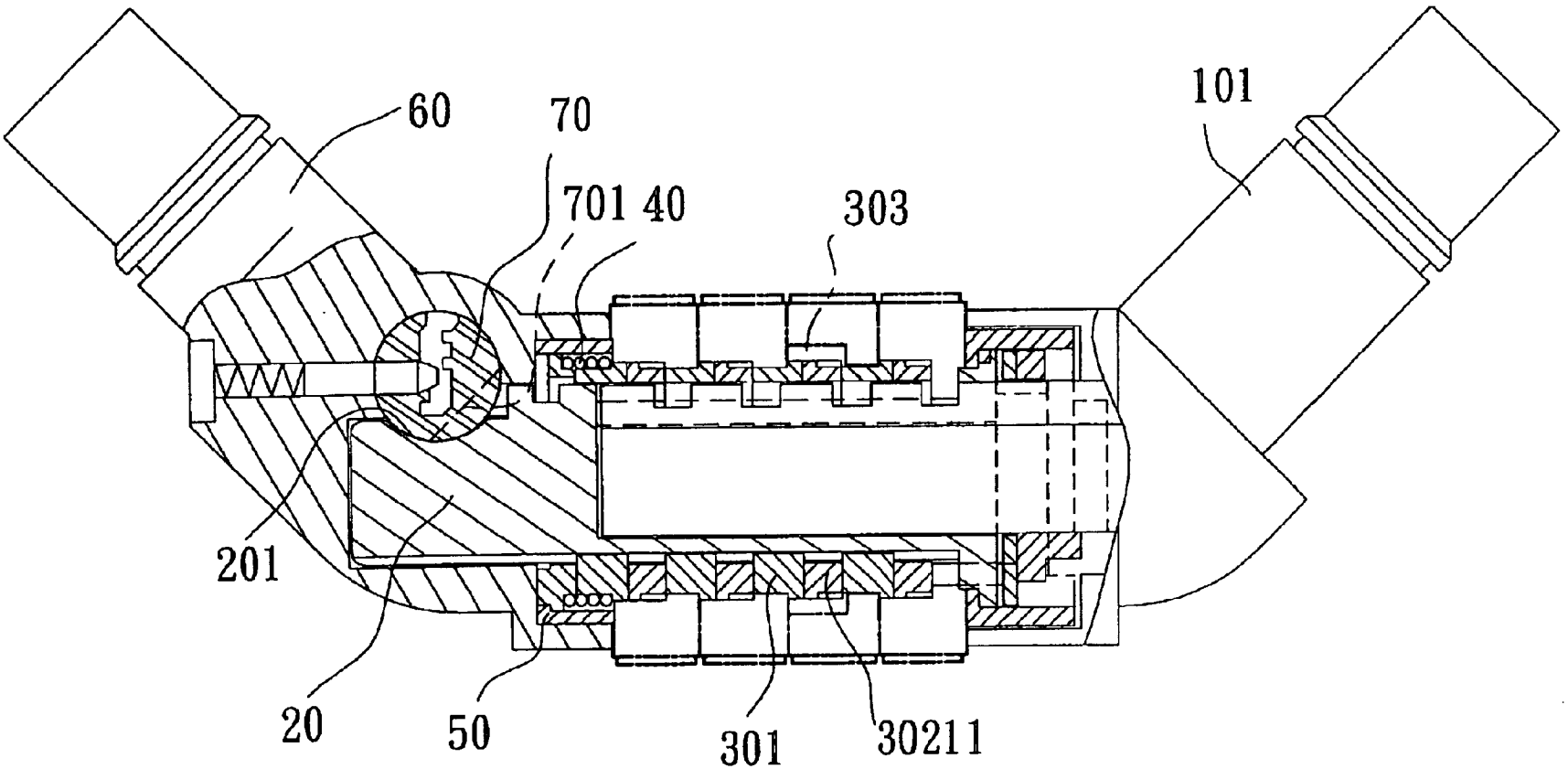
FIG. 2 is a cross-sectional view of the dual-use lock according to the present invention.

The female member 60 is normally securely connected with the tail end of the spindle 20 by means of the auxiliary lock member 70, as shown in FIG. 2, such that the gaps 501 of the protecting cap 50 can't show.

Figure 4:
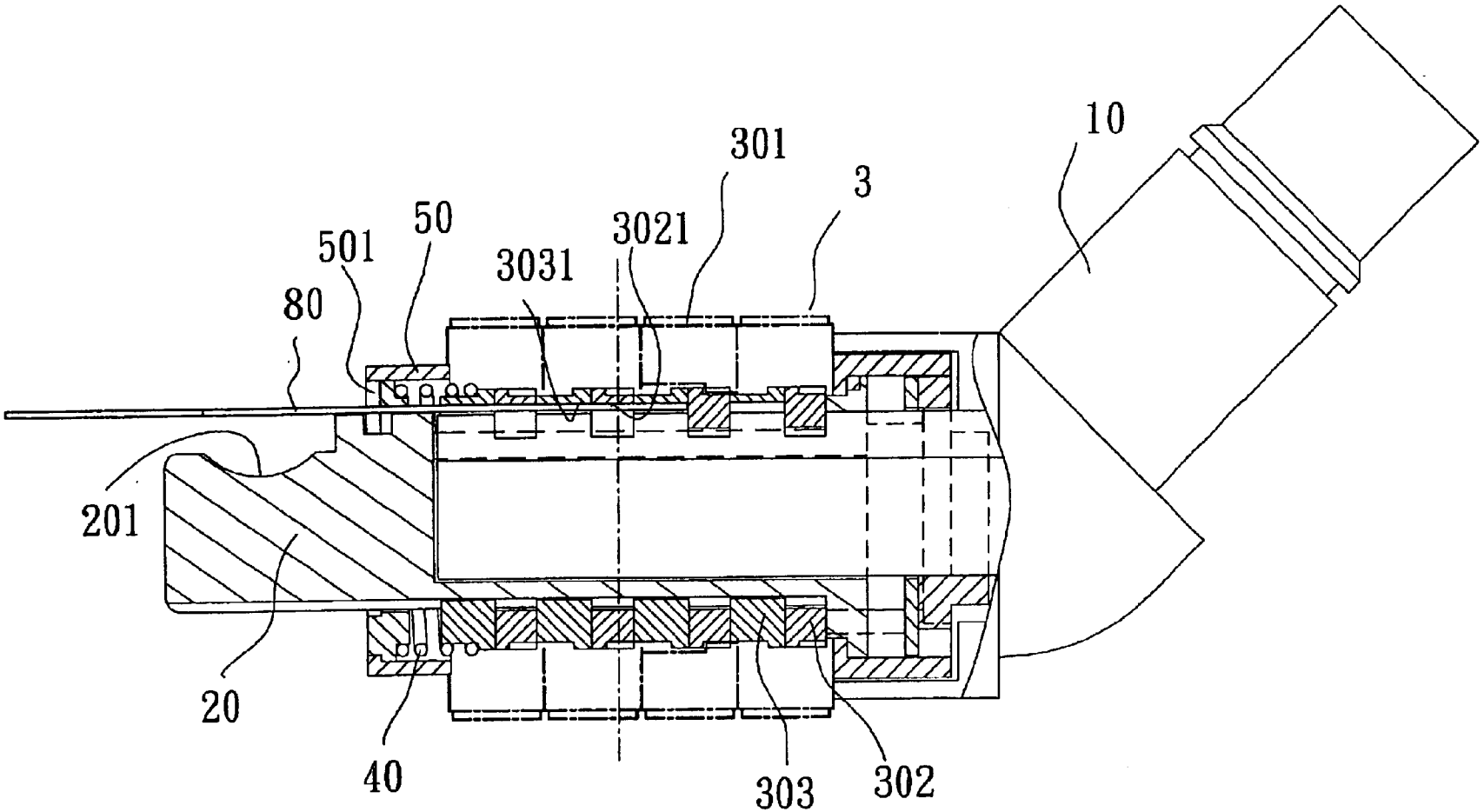
FIG. 4 is a cross-sectional view of the dual-use lock of the present invention under a second step of the combination tracing operation.
Figure 5:
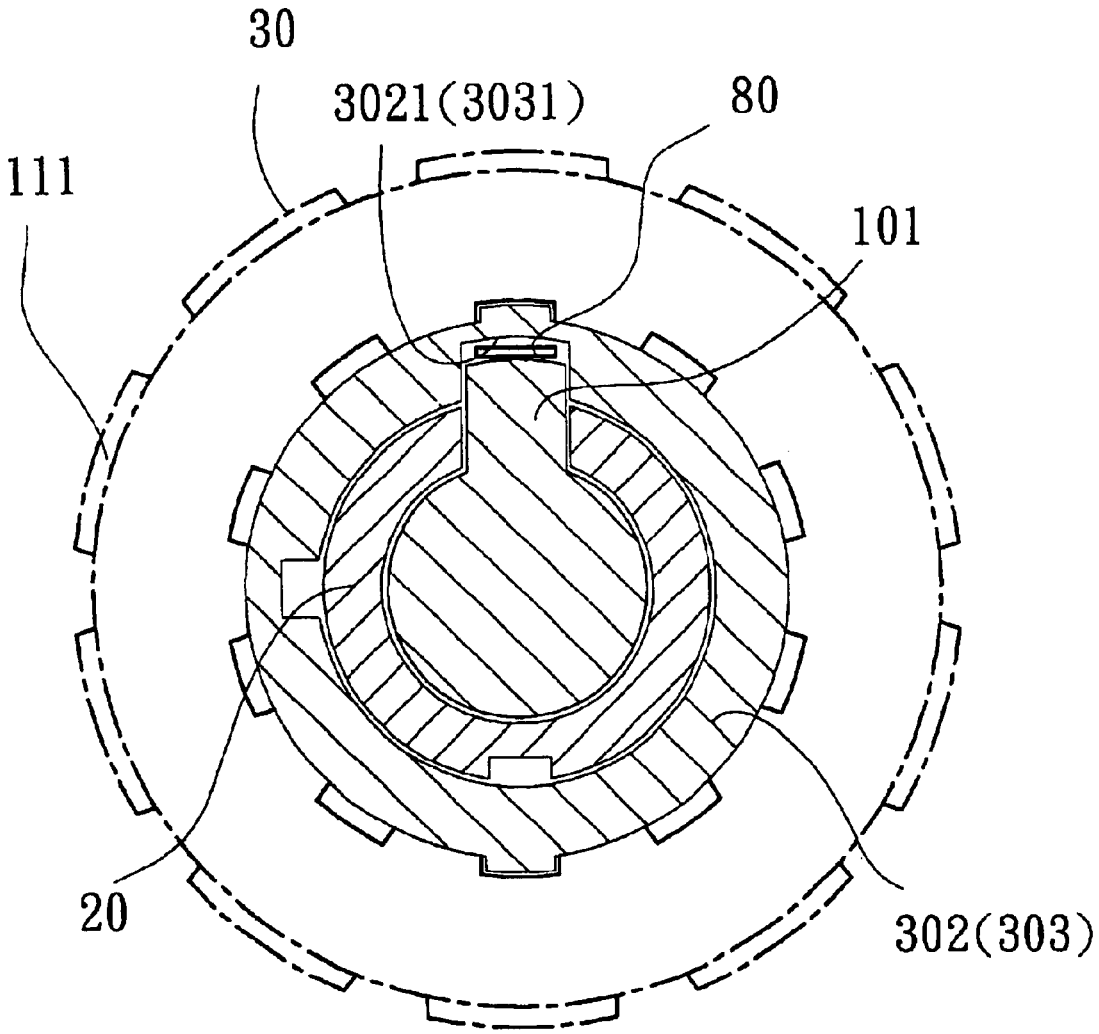
FIG. 5 is a cross-sectional view of the dual-use lock of the present invention under a third step of the combination tracing operation.
Figure 6:
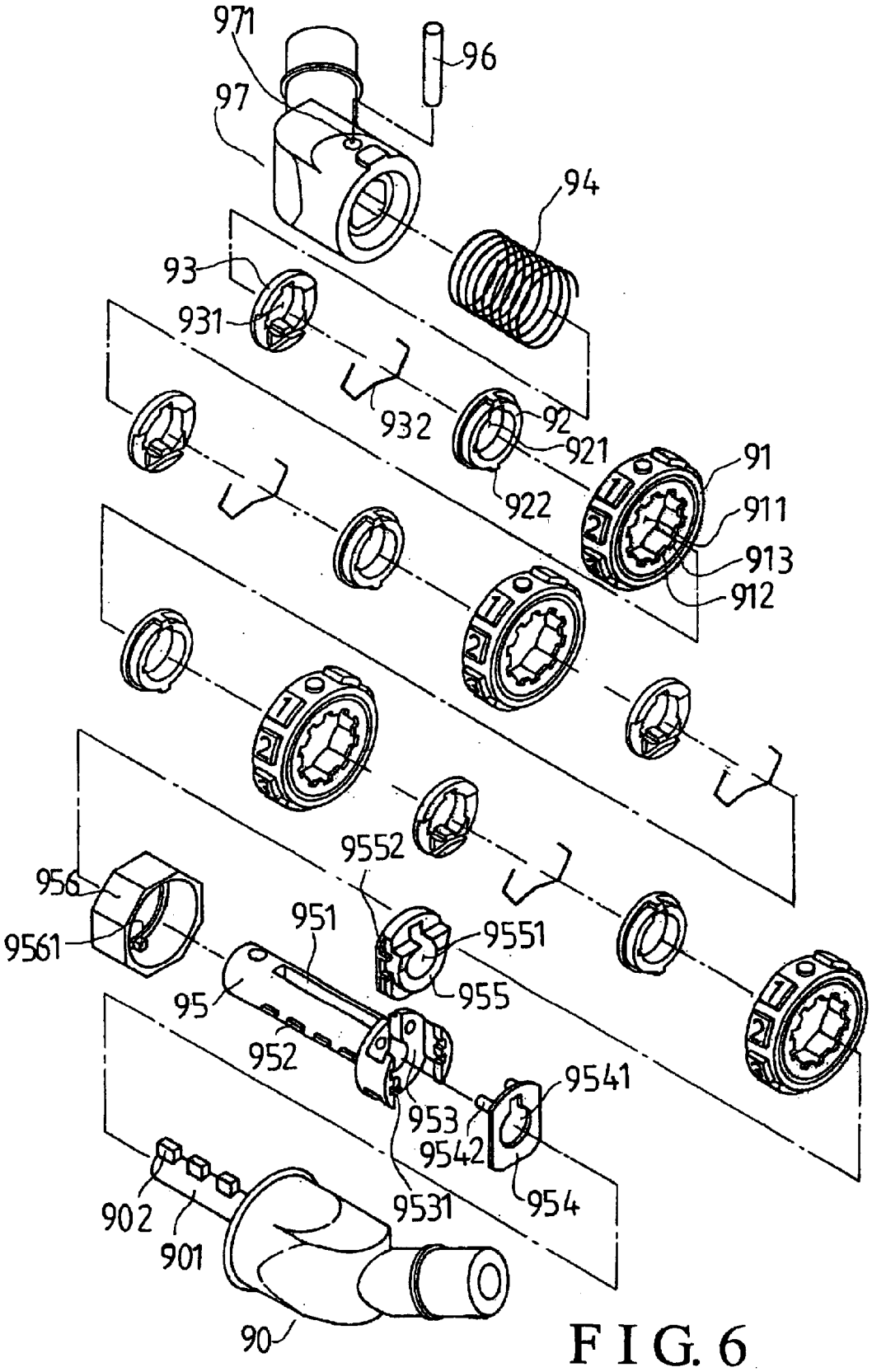
F I G. 6 (PRIOR ART)
FIG. 6 is an exploded perspective view of the conventional changeable combination lock as described in the Background.

The auxiliary lock member 70 is operated with the key such that the recess 701 opposes the recess 201 for the spindle 20 to be separable from the female member 60, as shown in FIG. 3, and then the female member 60 is removed from the spindle 20 (FIG. 4) in case the user has forgotten the unlocking numeral combination of the dials 301 after he locked the present combination lock; thus, the gaps 501 show. Then, the user can insert a probe in the gap 501, and manage to pass the probe 80 through all of the gaps 3021 of the tooth dishes 302 one by one while turning the dials 301. Thus, the original unlocking numeral combination will be traced as soon as the probe 80 is inserted through all of the gaps 3021 and 3031. And, the tooth dishes 302 no longer stop the teeth 101 of the male member 10.

From the above description, it can be easily understood that the combination lock of the present invention has advantages as followings:

1. Because the present lock has the auxiliary lock member 70 for connecting the spindle 20 to the female member 60, the spindle 20 can be made separable from the female member 60 by means of unlocking the lock member 70 with a key in case the user has forgotten the unlocking numeral combination after he locked the present combination lock. Consequently, an object still can be easily and rapidly released that has been locked with the lock even if the user has forgotten the combination.
2. In case the original unlocking numeral combination has been forgotten, it can be easily traced with the help of a probe, and in turns, the lock is still in good shape for use.

What is claimed is:

1. A dual-use lock whose unlocking numeral combination can be traced after having been forgotten, comprising a male member securely connected with one end of a cable; the male member having spaced teeth along a rod portion thereof;

a female member securely connected with other end of the cable;

a spindle for allowing insertion of the rod portion of the male member therein; the spindle being inserted in the female member at a tail end thereof;

a plurality of dial assemblies arranged around the spindle; each dial assembly including both a dial with numerals thereon, and a tooth dish releaseably engaging the dial to be capable of turning together with the dial; the tooth dishes each having a gap on an inward edge; the gaps of the tooth dishes together being capable of forming a passage for allowing separation of the male member from the spindle when the dials are turned to an unlocking orientation; the tooth dishes being capable of stopping the teeth of the male member to prevent separation of the male member from the spindle when the dials are turned away from the unlocking orientation; and an auxiliary lock member fitted to the female member for releaseably securing the spindle to the female member, thereby being operable with a key thereof to become unlocked for both the male member and the spindle together to become separable from the female member while the male member is secured to the spindle by the tooth dishes;

the auxiliary lock member having a recess, and an engaging portion next to the recess; the auxiliary lock member detaining the spindle when the engaging portion thereof is fitted in a securing recess of the tail end of the spindle; the auxiliary lock member releasing the spindle when the recess thereof opposes the securing recess of the tail end of the spindle.

2. The dual-use lock as claimed in claim 1, wherein a protecting cap is securely disposed around the tail end of the spindle; the protecting cap having a gap, which will be aligned with the gaps of the tooth dishes when the dials are turned to the unlocking orientation, thereby allowing one to trace an unlocking numeral combination of the dials by means of managing to pass a probe from the gap of the protecting cap through all of the gaps of the tooth dishes one by one while turning the dials after the spindle has been separated from the female member for the gap of the protecting cap to show.

* * * * *